US012195858B2

(12) United States Patent
Ueno et al.

(10) Patent No.: US 12,195,858 B2
(45) **Date of Patent: *Jan. 14, 2025**

(54) SURFACE-TREATED STEEL SHEET AND METHOD OF PRODUCING THE SAME

(71) Applicant: JFE STEEL CORPORATION, Tokyo (JP)

(72) Inventors: Takashi Ueno, Tokyo (JP); Yoichiro Yamanaka, Tokyo (JP); Yoshitsugu Suzuki, Tokyo (JP); Masanari Tomozawa, Tokyo (JP); Haruo Nakamichi, Tokyo (JP); Takashi Kawano, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 18/256,988

(22) PCT Filed: Nov. 29, 2021

(86) PCT No.: PCT/JP2021/043711

§ 371 (c)(1),
(2) Date: Jun. 12, 2023

(87) PCT Pub. No.: WO2022/138006

PCT Pub. Date: Jun. 30, 2022

(65) Prior Publication Data

US 2024/0068107 A1 Feb. 29, 2024

(30) Foreign Application Priority Data

Dec. 21, 2020 (JP) ..... 2020-211810

(51) Int. Cl.

| | |
|---|---|
| ***C23C 28/00*** | (2006.01) |
| ***C21D 9/46*** | (2006.01) |
| ***C23C 2/08*** | (2006.01) |
| ***C23C 2/40*** | (2006.01) |
| ***C25D 3/06*** | (2006.01) |
| ***C25D 5/12*** | (2006.01) |

(52) U.S. Cl.

CPC ..... *C23C 28/345* (2013.01); *C21D 9/46* (2013.01); *C23C 2/08* (2013.01); *C23C 2/40* (2013.01); *C23C 28/32* (2013.01); *C25D 3/06* (2013.01); *C25D 5/12* (2013.01); *C23C 2222/10* (2013.01)

(58) Field of Classification Search

None

See application file for complete search history.

(56) References Cited

U.S. PATENT DOCUMENTS

| | | | | |
|---|---|---|---|---|
| 4,687,713 | A * | 8/1987 | Ogata | C25D 11/38 205/171 |
| 6,280,852 | B1 * | 8/2001 | Shimizu | B32B 15/08 427/407.1 |
| 2014/0227529 | A1 * | 8/2014 | Yamanaka | C08J 7/043 428/416 |
| 2015/0064494 | A1 | 3/2015 | Wijenberg et al. | |
| 2015/0337448 | A1 | 11/2015 | Wijenberg et al. | |
| 2018/0355496 | A1 * | 12/2018 | Nakagawa | C25D 5/605 |
| 2020/0190679 | A1 | 6/2020 | Marmann et al. | |

FOREIGN PATENT DOCUMENTS

| | | | | |
|---|---|---|---|---|
| GB | 2046304 | A | 11/1980 | |
| JP | S55134197 | A | 10/1980 | |
| JP | S5735699 | A | 2/1982 | |
| JP | S57152497 | A | 9/1982 | |
| JP | S58110695 | A | 7/1983 | |
| JP | S5989784 | A | 5/1984 | |
| JP | 11029897 | A * | 2/1999 | C23C 10/60 |
| JP | 2002348698 | A | 12/2002 | |
| JP | 2015520794 | A | 7/2015 | |
| JP | 2016505708 | A | 2/2016 | |
| JP | 2018135569 | A | 8/2018 | |
| JP | 2020109205 | A | 7/2020 | |
| JP | 2020117748 | A | 8/2020 | |
| JP | 2020200533 | A | 12/2020 | |
| WO | 2012114737 | A1 | 8/2012 | |
| WO | 2015177315 | A1 | 11/2015 | |

OTHER PUBLICATIONS

Alpha-Measure, "Specifications of Deionized Water", accessed Jul. 2, 2024, https://alpha-measure.com/deionized-water-conductivity/ (Year: 2024).*

Feb. 15, 2022, International Search Report issued in the International Patent Application No. PCT/JP2021/043711.

Jan. 5, 2024, the Extended European Search Report issued by the European Patent Office in the corresponding European Patent Application No. 21910158.1.

Yolanda Hedberg et al., Correlation between surface physicochemical properties and the release of iron from stainless steel AISI 304 in biological media, Colloids and Surfaces B: Biointerfaces, 2014, pp. 216-222, vol. 122.

(Continued)

*Primary Examiner* — Seth Dumbris

(74) *Attorney, Agent, or Firm* — KENJA IP LAW PC

(57) ABSTRACT

It is provided a surface-treated steel sheet that can be produced without using hexavalent chromium and has excellent sulfide staining resistance and coating secondary adhesion. It is a surface-treated steel sheet having: a Sn plating layer; a metallic Cr layer disposed on the Sn plating layer; and a Cr oxide layer disposed on the metallic Cr layer, on at least one surface of a steel sheet, and the surface-treated steel sheet has a water contact angle of 50° or less and a total atomic ratio of K, Na, Mg, and Ca adsorbed on the surface to Cr of 5% or less.

9 Claims, No Drawings

(56) References Cited

OTHER PUBLICATIONS

May 8, 2024, Office Action issued by the IP Australia in the corresponding Australian Patent Application No. 2021406791.

* cited by examiner

SURFACE-TREATED STEEL SHEET AND METHOD OF PRODUCING THE SAME

TECHNICAL FIELD

This disclosure relates to a surface-treated steel sheet, and in particular, to a surface-treated steel sheet with excellent sulfide staining resistance when coated, as well as excellent adhesion to the coating layer in a wet environment. The surface-treated steel sheet of this disclosure can be suitably used for a container such as a can. This disclosure also relates to a method of producing the surface-treated steel sheet.

BACKGROUND

A Sn plating steel sheet (tinplate), one kind of surface-treated steel sheet, has been widely used as a material for various metal cans, including beverage cans, food cans, pails, and 18-liter cans, because of its excellent corrosion resistance, weldability, and workability, and its ease of production.

The surface-treated steel sheet used for these applications is required to have excellent adhesion to a coating material and also have excellent resistance (sulfide staining resistance) to discoloration (sulfide staining) caused by the reaction of sulfur and Sn derived from the can contents (in particular, protein). Therefore, it is common for the Sn plating steel sheet to be subjected to chromating treatment to improve the coating adhesion property and the sulfide staining resistance.

The chromating treatment is one type of surface treatment using a treatment solution containing chromium compounds such as chromic acids and chromates. Typically, as described in PTLs 1 to 3, a metallic Cr layer and a Cr oxide layer are formed on the surface of a steel sheet by cathodic electrolysis in an electrolyte containing hexavalent chromium compounds.

However, in recent years, increasing environmental awareness has led to a worldwide trend toward regulating the use of hexavalent Cr. Therefore, there is a need to establish a production method that does not use hexavalent chromium also in the field of surface-treated steel sheets used for containers, etc.

For example, PTL 4 proposes a surface-treated steel sheet with a layer containing zirconium compounds formed on the surface of a Sn plating steel sheet.

As another method of forming a surface-treated steel sheet without using hexavalent chromium, a method using hexavalent chromium has been also proposed. For example, PTLs 5 and 6 propose a method of forming a surface treatment layer consisting of a metallic Cr layer and a Cr oxide layer on the surface of a Sn plating steel sheet by electrolysis treatment in an electrolyte containing trivalent chromium compounds such as basic chromic sulfate.

CITATION LIST

Patent Literature

PTL 1: JP558-110695
PTL 2: JPS55-134197
PTL 3: JPS57-035699

PTL 4: JP2018-135569
PTL 5: JP2016-505708
PTL 6: JP2015-520794

SUMMARY

Technical Problem

However, the above conventional techniques have the problems described below.

For example, the surface-treated steel sheet proposed in PTL 4 can be formed without chromating treatment. Further, according to PTL 4, the surface-treated steel sheet has excellent sulfide staining resistance and painting layer adhesion.

However, in PTL 4, the painting layer adhesion was evaluated under mild conditions compared to the actual can environment, and in reality, the surface-treated steel sheet proposed in PTL 4 has insufficient adhesion to a coating material in a wet condition, which is a more severe condition (hereinafter referred to as "coating secondary adhesion").

According to the method proposed in PTLs 5 and 6, the surface treatment layer can be formed without using hexavalent chromium. Further, according to PTLs 5 and 6, the surface-treated steel sheet obtained by the above method has excellent adhesion to a resin film and a coating material in a wet environment.

However, similarly to PTL 4, also in PTLs 5 and 6, the adhesion was evaluated under mild conditions compared to the actual can environment, and in reality, the surface-treated steel sheet proposed in PTLs 5 and 6 has insufficient coating secondary adhesion.

Thus, a surface-treated steel sheet that can be produced without using hexavalent chromium and has excellent sulfide staining resistance and coating secondary adhesion has yet to be realized.

This disclosure has been developed in light of the above circumstances. It could be helpful to provide a surface-treated steel sheet that can be produced without using hexavalent chromium and has excellent sulfide staining resistance and coating secondary adhesion.

Solution to Problem

As a result of intensive studies made to achieve the above object, we discovered the following (1) and (2).

(1) In a surface-treated steel sheet having a metallic Cr layer and a Cr oxide layer on a Sn plating layer, controlling each of the water contact angle and the total atomic ratio of K, Na, Mg, and Ca adsorbed on the surface to Cr within a specific range can obtain a surface-treated steel sheet with excellent sulfide staining resistance and coating secondary adhesion.

(2) The above surface-treated steel sheet can be produced by performing cathodic electrolysis treatment using an electrolyte containing trivalent chromium ions prepared by a specific method, and then performing the last water washing using water with an electrical conductivity of a predetermined value or less.

This disclosure has been made based on the aforementioned discoveries. We thus provide:

1. A surface-treated steel sheet having:
a Sn plating layer;
a metallic Cr layer disposed on the Sn plating layer; and
a Cr oxide layer disposed on the metallic Cr layer, on at least one surface of a steel sheet, the surface-treated steel sheet having:

a water contact angle of 50° or less; and a total atomic ratio of K, Na, Mg, and Ca adsorbed on the surface to Cr of 5% or less.

2. The surface-treated steel sheet according to 1. above, wherein the Sn plating layer has a Sn coating weight of 0.1 $g/m^2$ to 20.0 $g/m^2$ per surface of the steel sheet.

3. The surface-treated steel sheet according to 1. or 2. above, wherein the metallic Cr layer has a thickness of 0.1 nm to 100 nm.

4. The surface-treated steel sheet according to any one of 1. to 3. above, wherein the Cr oxide layer has a thickness of 0.5 nm to 15 nm.

5. The surface-treated steel sheet according to any one of 1. to 4. above, having an atomic ratio of Sn on the surface of the surface-treated steel sheet to Cr of 100% or less.

6. The surface-treated steel sheet according to any one of 1. to 5. above, further having a Ni-containing layer disposed below the Sn plating layer.

7. The surface-treated steel sheet according to 6. above, wherein the Ni-containing layer has a Ni coating weight of 2 $mg/m^2$ to 2000 $mg/m^2$ per surface of the steel sheet.

8. A method of producing a surface-treated steel sheet having: a Sn plating layer; a metallic Cr layer disposed on the Sn plating layer; and a Cr oxide layer disposed on the metallic Cr layer, on at least one surface of a steel sheet, the method comprising:

an electrolyte preparation process to prepare an electrolyte containing trivalent chromium ions;

a cathodic electrolysis treatment process to subject a steel sheet having a Sn plating layer on at least one surface to cathodic electrolysis treatment in the electrolyte; and a water washing process to subject the steel sheet after the cathodic electrolysis treatment to water washing at least once;

wherein, in the electrolyte preparation process, the electrolyte is prepared by:

mixing a trivalent chromium ion source, a carboxylic acid compound, and water; and adjusting the pH to 4.0 to 7.0 and the temperature to 40° C. to 70° C., and in the water washing process, at least the last water washing uses water with an electrical conductivity of 100 μS/m or less.

9. The method of producing a surface-treated steel sheet according to 8. above, wherein the surface-treated steel sheet further has a Ni-containing layer disposed below the Sn plating layer.

Advantageous Effect

This disclosure can provide a surface-treated steel sheet that has excellent sulfide staining resistance and coating secondary adhesion without using hexavalent chromium. The surface-treated steel sheet of this disclosure can be suitably used as a material for a container, etc.

DETAILED DESCRIPTION

The following provides details of a method of carrying out this disclosure. The following description merely presents examples of preferred embodiments of this disclosure, and this disclosure is not limited to these embodiments.

A surface-treated steel sheet in one of the disclosed embodiments is a surface-treated steel sheet having, a Sn plating layer, a metallic Cr layer disposed on the Sn plating layer, and a Cr oxide layer disposed on the metallic Cr layer, on at least one surface of a steel sheet. In this disclosure, it is important that the surface-treated steel sheet have a water contact angle of 50° or less and a total atomic ratio of K, Na, Mg, and Ca adsorbed on the surface to Cr of 5% or less. The following describes each of the features of the surface-treated steel sheet.

[Steel Sheet]

Any steel sheet can be used as the steel sheet without any particular limitation. However, it is preferable to use a steel sheet for can. For example, an ultra low carbon steel sheet or a low carbon steel sheet can be used as the steel sheet. A method of producing the steel sheet is also not particularly limited. A steel sheet produced by any method can be used. However, a cold-rolled steel sheet may be usually used. The cold-rolled steel sheet can be produced by general production processes, for example, including hot rolling, acid cleaning, cold rolling, annealing, and temper rolling.

The chemical composition of the steel sheet is not particularly limited. However, the Cr content is preferably 0.10 mass % or less, and more preferably 0.08 mass % or less. If the Cr content of the steel sheet is within the above range, there will be no excessive Cr concentration on the surface of the steel sheet. Consequently, the atomic ratio of Sn to Cr on the surface of the finally obtained surface-treated steel sheet can be 100% or less. In addition, the steel sheet may contain C, Mn, P, S, Si, Cu, Ni, Mo, Al, and inevitable impurities to the extent that the effects in the scope of this disclosure are not impaired. In this case, for example, a steel sheet having a chemical composition specified in ASTM A623M-09 can be suitably used as the steel sheet.

In one of the embodiments, it is preferable to use a steel sheet having a chemical composition containing, in mass %:

C: 0.0001% to 0.13%;

Si: 0% to 0.020%;

Mn: 0.01% to 0.60%;

P: 0% to 0.020%;

S: 0% to 0.030%;

Al: 0% to 0.20%;

N: 0% to 0.040%;

Cu: 0% to 0.20%;

Ni: 0% to 0.15%;

Cr: 0% to 0.10%;

Mo: 0% to 0.05%;

Ti: 0% to 0.020%;

Nb: 0% to 0.020%;

B: 0% to 0.020%;

Ca: 0% to 0.020%;

Sn: 0% to 0.020%; and

Sb: 0% to 0.020%;

with the balance being Fe and inevitable impurities. In the above chemical composition, Si, P, S, Al, and N are components that are preferable with lower content, while Cu, Ni, Cr, Mo, Ti, Nb, B, Ca, Sn, and Sb are optional components that can be added.

The thickness of the steel sheet is not particularly limited. However, it is preferably 0.60 mm or less. The "steel sheet" is defined here to include "steel strip".

[Sn Plating Layer]

The Sn plating layer may be provided on at least one surface of the steel sheet, and may be provided on both surfaces. The Sn plating layer may cover at least a part of the steel sheet, and may cover the entire surface on which the Sn plating layer is provided. The Sn plating layer may be a continuous layer or a discontinuous layer. The discontinuous layer is, for example, a layer having an island structure.

The Sn plating layer includes a Sn plating layer obtained by partially alloying that Sn plating layer. For example, the Sn plating layer also includes a Sn plating layer obtained by making a part of that Sn plating layer into a Sn alloy layer by heat and melt treatment after Sn plating. Examples of the Sn plating layer include a Fe—Sn alloy layer and a Fe—Sn—Ni alloy layer.

For example, heating and melting Sn by electrical resistance heating, etc. after Sn plating can make a part of the steel sheet side of the Sn plating layer into a Fe—Sn alloy layer. In addition, performing Sn plating on a steel sheet having a Ni-containing layer on the surface and further heating and melting Sn by electrical resistance heating, etc. can make a part of the steel sheet side of the Sn plating layer into one or both of a Fe—Sn—Ni alloy layer and a Fe—Sn alloy layer.

The Sn coating weight on the Sn plating layer can be any weight without any particular limitation. However, from the viewpoint of further improving the appearance and the corrosion resistance of the surface-treated steel sheet, the Sn coating weight is preferably 0.1 g/m$^2$ to 20.0 g/m$^2$ per surface of the steel sheet. From the same viewpoint, the Sn coating weight is more preferably 0.2 g/m$^2$ or more. From the viewpoint of further improving the workability, the Sn coating weight is further preferably 1.0 g/m$^2$ or more.

The Sn coating weight is, for example, a value measured by the electrolysis method or the X-ray fluorescence method described in JIS G 3303.

The formation of the Sn plating layer can be done by any method, including electroplating and hot dip coating, without any particular limitation. When forming the Sn plating layer by electroplating, any plating bath can be used. Examples of the plating bath that can be used include a phenolsulfonic acid Sn plating bath, a methanesulfonic acid Sn plating bath, or a halogenated Sn plating bath.

After forming the Sn plating layer, reflow treatment may be performed. When performing the reflow treatment, heating the Sn plating layer to a temperature equal to or more than the melting point of Sn (231.9° C.) can form an alloy layer such as a Fe—Sn alloy layer on the lower layer (steel sheet side) of the plating layer of Sn alone. If the reflow treatment is omitted, a Sn plating steel sheet having the plating layer of Sn alone is obtained.

[Ni-Containing Layer]

The above surface-treated steel sheet can further optionally have a Ni-containing layer. For example, the surface-treated steel sheet in one of the embodiments may be a surface-treated steel sheet having a Ni-containing layer, a Sn plating layer disposed on the Ni-containing layer, a metallic Cr layer disposed on the Sn plating layer, and a Cr oxide layer disposed on the metallic Cr layer, on at least one surface of a steel sheet.

As the Ni-containing layer, any layer that contains nickel can be used. For example, one or both of a Ni layer and a Ni alloy layer can be used. The Ni layer is, for example, a Ni plating layer. The Ni alloy layer is, for example, a Ni—Fe alloy layer. Forming a Sn plating layer on the Ni-containing layer and subsequently performing reflow treatment can form a Fe—Sn—Ni alloy layer, a Fe—Sn alloy layer, etc. on the lower layer (steel sheet side) of the plating layer of Sn alone.

The method of forming the Ni-containing layer is not particularly limited, and any method, such as electroplating, can be used. When forming a Ni—Fe alloy layer as the Ni-containing layer, the Ni—Fe alloy layer can be formed by forming a Ni layer on the steel sheet surface by electroplating or other methods and then annealing it.

The Ni coating weight of the Ni-containing layer is not particularly limited. However, from the viewpoint of further improving the sulfide staining resistance, the Ni coating weight per surface of the steel sheet is preferably 2 mg/m$^2$ or more. From a cost perspective, the Ni coating weight per surface of the steel sheet is preferably 2000 mg/m$^2$ or less.

The surface side of the Sn plating layer may contain Sn oxides or not at all. The Sn oxides are formed by reflow treatment and dissolved oxygen contained in water for water washing after Sn plating, but are reduced by the cathodic electrolysis treatment process, which forms a metallic Cr layer and a Cr oxide layer, described below and by the pretreatment described below. A lower Sn oxide content in the finally obtained surface-treated steel sheet makes the coating secondary adhesion and the sulfide staining resistance excellent. Thus, it is preferable to control the Sn oxide content contained in the Sn plating layer by pretreatment, etc. as described below.

The Sn oxide content contained in the Sn plating layer can be measured from the current-potential curve obtained by immersing the finally obtained surface-treated steel sheet in a 0.001 N hydrogen bromide aqueous solution at 25° C., which has been replaced with inert gas, and sweeping the potential from the immersion potential to the negative side at a sweep rate of 1 mV/sec. For example, Ar can be used as the inert gas. A saturated KCl—Ag/AgCl electrode is used as a reference electrode, and a platinum plate is used as a counter electrode. The current in the potential range of −600 mV to −400 mV vs the saturated KCl—Ag/AgCl reference electrode in the current-potential curve corresponds to a reduction current of Sn oxide contained in the Sn plating layer. The electrical quantity obtained by integrating the reduction currents in the above range corresponds to the Sn oxide content. When Sn oxides are contained in the metallic Cr layer and the Cr oxide layer described below, the reduction currents in the above range include the reduction currents of Sn oxides in the metallic Cr layer and the Cr oxide layer described below, but the value is extremely small. Therefore, from the viewpoint of controlling the Sn oxide contained in the Sn plating layer, there is no problem if the reduction currents in the above range are measured. The Sn oxide content is preferably 4.0 mC/cm$^2$ or less, and more preferably 3.5 mC/cm$^2$ or less. The current in the potential range of −600 mV to −400 mV in the current-potential curve vs the saturated KCl—Ag/AgCl reference electrode also includes the current corresponding to hydrogen reduction. However, from the viewpoint of controlling the Sn oxide content, the electrical quantity obtained by integrating the reduction currents in the above range may be used. In the potential range of −700 mV to −900 mV vs the saturated KCl—Ag/AgCl reference electrode in the current-potential curve, a current peak corresponding to a reduction current of the Cr oxide layer described below is found.

[Metallic Cr Layer]

A metallic Cr layer is present on the Sn plating layer.

The thickness of the metallic Cr layer is not particularly limited. However, from the viewpoint of further improving the sulfide staining resistance, the thickness of the metallic Cr layer is preferably 0.1 nm or more, more preferably 0.3 nm or more, and further preferably 0.5 nm or more. On the other hand, no particular upper limit is also placed on the thickness of the metallic Cr layer. However, an excessively thick metallic Cr layer may increase the water contact angle described below to impair the coating secondary adhesion. Therefore, from the viewpoint of more stably ensuring the adhesion, the thickness of the metallic Cr layer is preferably 100 nm or less, more preferably 90 nm or less, and further preferably 80 nm or less. The thickness of the metallic Cr layer can be measured by a method described in Examples, using X-ray photoelectron spectroscopy (XPS).

Metallic Cr that constitutes the metallic Cr layer may be amorphous Cr or crystalline Cr. That is, the metallic Cr layer can contain one or both of amorphous Cr and crystalline Cr. The metallic Cr layer produced by the method described below generally contains amorphous Cr and may further contain crystalline Cr. The formation mechanism of the metallic Cr layer is not clear. However, it is thought that partial crystallization proceeds during the formation of amorphous Cr, resulting in a metallic Cr layer containing both amorphous and crystalline phases.

The ratio of crystalline Cr to the sum of amorphous Cr and crystalline Cr contained in the metallic Cr layer is preferably 0% or more and 80% or less, and more preferably 0% or more and 50% or less. The ratio of crystalline Cr can be measured by observing the metallic Cr layer with a scanning transmission electron microscope (STEM). Specifically, first, a STEM image is obtained at a magnification of 2 million times to 10 million times at a beam diameter that provides a resolution of 1 nm or less. In the obtained STEM image, the area where the lattice fringes can be seen is the crystalline phase, and the area where the maze pattern can be seen is the amorphous phase, and the areas of both are determined. From this result, the ratio of the area of crystalline Cr to the total area of amorphous Cr and crystalline Cr is calculated.

[Cr Oxide Layer]

A Cr oxide layer is present on the metallic Cr layer. The thickness of the Cr oxide layer is not particularly limited. However, it is preferably 0.5 nm or more. The thickness of the Cr oxide layer is preferably 15 nm or less. The thickness of the Cr oxide layer can be measured by the method described in Examples, using XPS.

One or both of the above metallic Cr layer and Cr oxide layer may contain C. No particular upper limit is placed on the C content in the metallic Cr layer. However, the atomic ratio of C to Cr is preferably 50% or less, and more preferably 45% or less. Similarly, no particular upper limit is placed on the C content in the Cr oxide layer. However, the atomic ratio of C to Cr is preferably 50% or less, and more preferably 45% or less. The metallic Cr and the Cr oxide layer may not contain C. Therefore, no particular lower limit is placed on the atomic ratio of C to Cr contained in each of the metallic Cr layer and the Cr oxide layer, and it may be 0%.

The C content in each of the metallic Cr layer and the Cr oxide layer is not particularly limited. However, it can be measured, for example, by XPS. That is, the C content in the metallic Cr layer may be obtained by performing sputtering from the topmost surface to a value equal to ½ the thickness of the metallic Cr layer plus the thickness of the Cr oxide layer, quantifying the atomic ratio using the relative sensitivity factor method from the integrated intensity of the Cr2p and C1s narrow spectra, and calculating C atomic ratio/Cr atomic ratio. The C content in the Cr oxide layer may be obtained by performing sputtering from the topmost surface to a value of ½ the thickness of the Cr oxide layer, quantifying the atomic ratio using the relative sensitivity factor method from the integrated intensity of the Cr2p and C1s narrow spectra, and calculating C atomic ratio/Cr atomic ratio. For the measurement, for example, a scanning X-ray photoelectron spectrometer PHI X-tool made by ULVAC-PHI can be used. The X-ray source is monochrome AlKα ray, the voltage is 15 kV, the beam diameter is 100 μmφ, and the extraction angle is 45°. The sputtering conditions may be Ar ions at an acceleration voltage of 1 kV, and the sputtering rate may be 1.50 nm/min in terms of $SiO_2$.

The mechanism by which C is contained in the metallic Cr layer and the Cr oxide layer is not clear. However, it is thought that a carboxylic acid compound contained in an electrolyte are decomposed to be incorporated into the layers during the process of forming the metallic Cr layer and the Cr oxide layer on the steel sheet.

The existence form of C in the metallic Cr layer and the Cr oxide layer is not particularly limited. However, if C presents as precipitates, the corrosion resistance may be reduced due to the formation of local batteries. Therefore, the sum of the volume fractions of carbides and clusters with a well-defined crystal structure is preferably 10% or less, and more preferably, they are not contained at all (0%). The presence or absence of carbides can be confirmed, for example, by composition analysis using energy dispersive X-ray spectroscopy (EDS) or wavelength dispersive X-ray spectroscopy (WDS) attached to a scanning electron microscope (SEM) or a transmission electron microscope (TEM). The presence or absence of clusters can be confirmed, for example, by performing cluster analysis on the data after three-dimensional composition analysis using a three-dimensional atom probe (3DAP).

The metallic Cr layer may contain O. No particular upper limit is placed on the O content in the metallic Cr layer. However, if the O content is high, Cr oxide may precipitate to decrease the corrosion resistance due to the formation of local batteries. Therefore, the O content, as the atomic ratio of O to Cr, is preferably 30% or less, and more preferably 25% or less. The metallic Cr layer may not contain O. Therefore, no particular lower limit is placed on the Cr content in the metallic Cr layer, and it may be 0%.

The O content in the metallic Cr layer can be measured by compositional analysis such as EDS and WDS, attached to a SEM and a TEM, or 3DAP.

One or both of the above metallic Cr layer and Cr oxide layer may contain Sn. No particular upper limit is placed on the Sn content in the metallic Cr layer. However, the atom ratio of Sn to Cr is preferably less than 100%. Similarly, no particular upper limit is place on the Sn content in the Cr oxide layer. However, the atom ratio of Sn to Cr is preferably less than 100%. The metallic Cr layer and the Cr oxide layer may not contain Sn. Therefore, no particular lower limit is placed on the atomic ratio of Sn to Cr, and it may be 0%.

The Sn content on the surface of the surface-treated steel sheet, i.e., the surface of the Cr oxide layer, is not particularly limited. However, a lower Fe content makes the coating secondary adhesion and the sulfide staining resistance excellent. Therefore, the atomic ratio of Sn to Cr on the surface of the surface-treated steel sheet is preferably 100% or less, and more preferably 80% or less.

The Sn content in the metallic Cr layer and the Cr oxide layer can be measured by XPS, similarly to the C content. The atomic ratio of Sn to Cr on the surface of the surface-treated steel sheet, i.e., the surface of the Cr oxide layer, can be measured by XPS on the surface of the surface-treated steel sheet. The Cr2p and Sn3d narrow spectra may be used to calculate the atomic ratio.

The mechanism by which Sn is contained in the metallic Cr layer and the Cr oxide layer is not clear. However, it is thought that Sn contained in the Sn plating layer dissolves in the electrolyte in minute amounts to be incorporated into the layers during the process of forming the metallic Cr layer and the Cr oxide layer on the steel sheet.

In addition to Cr, O, Sn, and C, and K, Na, Mg, and Ca described below, the above metallic Cr layer and Cr oxide layer may contain metallic impurities such as Cu, Zn, Ni, and Fe contained in an aqueous solution, and S, N, Cl, Br, etc. However, the presence of those elements may reduce the sulfide staining resistance and the adhesion. Therefore, the atomic ratio of the sum of elements other than Cr, O, Sn, C, K, Na, Mg, and Ca to Cr is preferably 3% or less, and more preferably, they are not contained at all (0%). The content of the above elements is not particularly limited. However, it can be measured by, for example, XPS, similarly to the C content.

The above metallic Cr layer and Cr oxide layer are preferably crack-free. The presence or absence of cracks can be confirmed, for example, by cutting out a cross-section of the layer with a focused ion beam (FIB) or the like and directly observing it with a transmission electron microscope (TEM).

The surface roughness of the surface-treated steel sheet of this disclosure is not significantly changed by the formation of the metallic Cr layer and the Cr oxide layer, and is usually about the same as the surface roughness of the used base steel sheet. The surface roughness of the surface-treated steel sheet is not particularly limited. However, the arithmetic mean roughness Ra is preferably 0.1 μm or more and 4 μm or less. The ten-point average roughness Rz is preferably 0.2 μm or more and 6 μm or less.

[Water Contact Angle]

In this disclosure, it is important that the surface-treated steel sheet have a water contact angle of 50° or less. Highly hydrophilizing the surface of the surface-treated steel sheet so that the water contact angle is 50° or less forms strong hydrogen bond between the resin contained in the coating material and the surface-treated steel sheet, resulting in high adhesion even in a wet environment. From the viewpoint of further improving the coating secondary adhesion, the water contact angle is preferably 48° or less, and more preferably 45° or less. A lower water contact angle is preferable from the viewpoint of improving the adhesion. Thus, no particular lower limit is placed on the water contact angle, and it may be 0°. However, from the viewpoint of ease of production, etc., it may be 5° or more, or even 8° or more. The water contact angle can be measured by the method described in Examples.

The mechanism by which the surface of the surface-treated steel sheet is hydrophilized is not clear. However, it is thought to be because carboxylic acids or carboxylates contained in the electrolyte are decomposed to be incorporated into the layers during the process of forming the metallic Cr layer and the Cr oxide layer by cathodic electrolysis in the electrolyte, thereby imparting hydrophilic functional groups such as carboxyl groups to the surface. However, if the electrolyte is not prepared under specific conditions as described below, the surface of the surface-treated steel sheet will not be hydrophilized even when the electrolyte contains carboxylic acids or carboxylates. The mechanism by which the electrolyte preparation conditions affect the hydrophilization of the surface of the surface-treated steel sheet is not clear. However, it is assumed to be due to the formation of complexes such that hydrophilic functional groups such as carboxyl groups are likely to be imparted to the surface, when the electrolyte is properly prepared under the conditions described below.

In a surface-treated steel sheet produced using conventional hexavalent chromium baths as proposed in PTLs 1 to 3, it has been reported that the composition of the chromium hydrated oxide layer present in the surface layer has a significant effect on the adhesion to the coating material or the film in a wet environment. In a wet environment, water that has penetrated through the coating layer or the film will inhibit the adhesion at the interface between the coating layer or the film and the chromium hydrated oxide layer. Therefore, it was thought that when hydrophilic OH groups are present in large numbers in the chromium hydrated oxide layer, spreading wetting of water at the interface is promoted to reduce adhesive strength. Therefore, in the conventional surface-treated steel sheet, the decrease in OH groups due to the progression of oxonation of chromium hydrated oxides, i.e., hydrophobization of the surface, improves the adhesion to the coating material or the film in a wet environment.

In contrast, this disclosure is based on a technical concept that is completely opposite to the above conventional technology, which is to form strong hydrogen bonds at the interface between the coating layer and the surface-treated steel sheet by hydrophilizing the surface to a near superhydrophilic level, thereby maintaining high adhesion even in a wet environment.

[Atomic Ratio of Adsorbed Element]

As described above, the surface-treated steel sheet of this disclosure has a high hydrophilic property with a water contact angle of 50° or less, and its surface is chemically active. Therefore, cations of elements such as K, Na, Mg, and Ca are likely to be adsorbed on the surface of the surface-treated steel sheet. We have found that simply setting the water contact angle to 50° or less does not provide the original adhesion due to the effect of the adsorbed cations. In this disclosure, reducing the amount of the cations adsorbed on the surface of the surface-treated steel sheet improves the adhesion to the resin, achieves excellent coating secondary adhesion, and exhibits a strong barrier against sulfur penetration, thus achieving excellent sulfide staining resistance.

Specifically, the total atomic ratio of K, Na, Mg, and Ca adsorbed on the surface of the surface-treated steel sheet to Cr is 5% or less, preferably 3% or less, and more preferably 1% or less. A lower total atomic ratio is better. Thus, no particular lower limit is placed, and the total atomic ratio may be 0%. The total atomic ratio can be measured by the method described in Examples.

[Production Method]

In a method of producing a surface-treated steel sheet in one of the embodiments, a surface-treated steel sheet with the above characteristics can be produced by the method described below.

The method of producing a surface-treated steel sheet in one of the embodiments is a method of producing a surface-treated steel sheet having a Sn plating layer, a metallic Cr layer disposed on the Sn plating layer, and a Cr oxide layer disposed on the metallic Cr layer, on at least one surface of a steel sheet, and the method includes the following processes (1) to (3). The following describes each process.

(1) Electrolyte preparation process to prepare an electrolyte containing trivalent chromium ions
(2) Cathodic electrolysis treatment process to subject a steel sheet having a Sn plating layer to cathodic electrolysis treatment in the electrolyte
(3) Water washing process to subject the steel sheet after the cathodic electrolysis treatment to water washing at least once

[Electrolyte Preparation Process]

(i) Mixing

In the above electrolyte preparation process, first, a trivalent chromium ion source, a carboxylic acid compound, and water are mixed to form an aqueous solution.

Any compound that can supply trivalent chromium ions can be used as the trivalent chromium ion source. For example, at least one selected from the group consisting of chromium chloride, chromium sulfate, and chromium nitrate can be used as the trivalent chromium ion source.

The content of trivalent chromium ion-containing source in the aqueous solution is not particularly limited. However, it is preferably 3 g/L or more and 50 g/L or less, and more preferably 5 g/L or more and 40 g/L or less in terms of trivalent chromium ions. BluCr® (BluCr is a registered trademark in Japan, other countries, or both) TFS A made by Atotech can be used as the trivalent chromium ion source.

Any carboxylic acid compound can be used as the carboxylic acid compound without any particular limitation. The carboxylic acid compound may be at least one of carboxylic acid and carboxylate, and it is preferably at least one of aliphatic carboxylic acid and aliphatic carboxylate. The carbon number of the aliphatic carboxylic acid is preferably 1 or more. The carbon number of the aliphatic carboxylic acid is preferably 10 or less, and more preferably 5 or less. The carbon number of the aliphatic carboxylate is preferably 1 or more. The carbon number of the aliphatic carboxylate is preferably 10 or less, and preferably 5 or less. The content of the carboxylic acid compound is not particularly limited. However, it is preferably 0.1 mol/L or more and 5.5 mol/L or less, and more preferably 0.15 mol/L or more and 5.3 mol/L or less. BluCr® TFS B made by Atotech can be used as the carboxylic acid compound.

In this disclosure, water is used as a solvent for preparing the electrolyte. As the water, it is preferable to use highly pure water such as ion-exchanged water in which cations have been removed in advance with ion-exchange resins, etc., or distilled water. As described below, from the viewpoint of reducing the amount of K, Na, Mg, and Ca contained in the electrolyte, it is preferable to use water with an electrical conductivity of 30 μS/m or less.

To reduce the amount of K, Na, Mg, and Ca adsorbed on the surface of the surface-treated steel sheet, it is preferable to intentionally not contain K, Na, Mg, and Ca in the above aqueous solution. Therefore, it is preferable not to contain K, Na, Mg, and Ca in the components added to the aqueous solution, such as the above trivalent chromium ion source and carboxylic acid compounds, and a pH adjuster detailed below. As the pH adjuster, it is preferable to use hydrochloric acid, sulfuric acid, nitric acid, etc. to decrease the pH and to use ammonia water, etc. to increase the pH. K, Na, Mg, and Ca unavoidably mixed in the aqueous solution or the electrolyte are acceptable. However, the total concentration of K, Na, Mg, and Ca is preferably 2.0 mol/L or less, more preferably 1.5 mol/L or less, and further preferably 1.0 mol/L or less.

To effectively suppress the formation of hexavalent chromium at the anode in the cathodic electrolysis treatment process and to improve the stability of the above electrolyte, it is preferable to further contain at least one kind of halide ion in the aqueous solution. The content of halide ion is not particularly limited. However, it is preferably 0.05 mol/L or more and 3.0 mol/L or less, and more preferably 0.10 mol/L or more and 2.5 mol/L or less. BluCr® TFS Cl and BluCr® TFS C2 made by Atotech can be used to contain the halide ion.

It is preferable not to add hexavalent chromium to the above aqueous solution. With the exception of a very small amount of hexavalent chromium formed at the anode in the cathodic electrolysis treatment process, no hexavalent chromium is contained in the above electrolyte. The very small amount of hexavalent chromium formed at the anode in the cathodic electrolysis treatment process is reduced to trivalent chromium. Thus, the concentration of hexavalent chromium in the electrolyte does not increase.

It is preferable not to intentionally add metal ions other than trivalent chromium ions to the above aqueous solution. The above metal ions are not limited, but include Cu ions, Zn ions, Ni ions, Fe ions, Sn ions, etc. Each content is preferably 0 mg/L or more and 40 mg/L or less, more preferably 0 mg/L or more and 20 mg/L or less, and most preferably 0 mg/L or more and 10 mg/L or less. Of the above metal ions, Sn ions may dissolve in the electrolyte to co-deposit in the layer when the steel sheet is immersed in the above electrolyte during the cathodic electrolysis treatment process. However, this does not affect the sulfide staining resistance and the coating secondary adhesion. The content of Sn ions is preferably 0 mg/L or more and 40 mg/L or less, more preferably 0 mg/L or more and 20 mg/L or less, and most preferably 0 mg/L or more and 10 mg/L or less. The Sn ion concentration is preferably in the above range during the initial make-up of electrolytic bath. However, it is preferable to maintain the Sn ion concentration in the electrolyte in the above range also during the cathodic electrolysis treatment process. Controlling the Sn ions in the above range does not interfere with the formation of the metallic Cr layer and the Cr oxide layer, thus enabling the metallic Cr layer and the Cr oxide layer to be formed with the required thicknesses.

(ii) Adjustment of pH and Temperature

Next, the electrolyte is prepared by adjusting the pH of the aqueous solution to 4.0 to 7.0 and the temperature of the aqueous solution to 40° C. to 70° C. To produce the above surface-treated steel sheet, simply dissolving the trivalent chromium ion source and the carboxylic acid compound in water is not enough. It is important to properly control the pH and the temperature as described above.

pH: 4.0 to 7.0

In the electrolyte preparation process, the pH of the aqueous solution after mixing is adjusted to 4.0 to 7.0. When the pH is less than 4.0 or greater than 7.0, the water contact angle of the surface-treated steel sheet produced using the resulting electrolyte is higher than 50°. The pH is preferably 4.5 or more. The pH is preferably 6.5 or less.

Temperature: 40° C. to 70° C.

In the electrolyte preparation process, the temperature of the aqueous solution after mixing is adjusted to 40° C. to 70° C. If the temperature is less than 40° C. or greater than 70° C., the water contact angle of the surface-treated steel sheet produced using the resulting electrolyte is greater than 50°. The holding time in the temperature range of 40° C. to 70° C. is not particularly limited.

The above procedure can obtain the electrolyte to be used in the next cathodic electrolysis treatment process. The electrolyte produced by the above procedure can be stored at room temperature.

[Cathodic Electrolysis Treatment Process]

Next, the steel sheet having a Sn plating layer on at least one surface is subjected to the cathodic electrolysis treatment in the electrolyte obtained in the above electrolyte preparation process. The cathodic electrolysis treatment can form a metallic Cr layer and a Cr oxide layer on the Sn plating layer.

In one of the embodiments, the surface-treated steel sheet can further have a Ni-containing layer disposed below the Sn plating layer. When producing the surface-treated steel sheet with a Ni-containing layer, a steel sheet having a Ni-containing layer on at least one surface and a Sn plating layer disposed on the Ni-containing layer may be subjected to cathodic electrolysis treatment.

The temperature of the electrolyte during the cathodic electrolysis treatment is not particularly limited. However, it is preferably in the temperature range of 40° C. or more and 70° C. or less to efficiently form the metallic Cr layer and the Cr oxide layer. From the viewpoint of stably producing the above surface-treated steel sheet, it is preferable to monitor the temperature of the electrolyte and maintain it in the above temperature range during the cathodic electrolysis treatment process.

The pH of the electrolyte during the cathodic electrolysis treatment is not particularly limited. However, it is preferably 4.0 or more, and more preferably 4.5 or more. The pH is preferably 7.0 or less, and more preferably 6.5 or less. From the viewpoint of stably producing the above surface-treated steel sheet, it is preferable to monitor the pH of the electrolyte and maintain it in the above pH range during the cathodic electrolysis treatment process.

The current density in the cathodic electrolysis treatment is not particularly limited and may be appropriately adjusted to form a desired surface treatment layer. However, an excessively high current density places an excessive burden on a cathodic electrolysis treatment device. Therefore, the current density is preferably 200.0 A/dm$^2$ or less, and more preferably 100 A/dm$^2$ or less. No particular lower limit is also placed on the current density. However, excessively low current density may generate hexavalent Cr in the electrolyte to impair the stability of the bath. Therefore, the current density is preferably 5.0 A/dm$^2$ or more, and more preferably 10.0 A/dm$^2$ or more.

The number of times the steel sheet is subjected to the cathodic electrolysis treatment is not particularly limited and can be any number of times. In other words, the cathodic electrolysis treatment can be performed using an electrolysis treatment device having one or two or more any number of passes. For example, it is also preferable to perform the cathodic electrolysis treatment continuously by passing the steel sheet (steel strip) through a plurality of passes while conveying it. The increased number of times of the cathodic electrolysis treatment (i.e., the number of passes) requires a commensurate number of electrolytic cells. Thus, the number of times of the cathodic electrolysis treatment (the number of passes) is preferably 20 or less.

The electrolysis time per pass is not particularly limited. However, if the electrolysis time per pass is too long, the steel sheet transport speed (line speed) is reduced to decrease productivity. Therefore, the electrolysis time per pass is preferably 5 seconds or less, and more preferably 3 seconds or less. No particular lower limit is also placed on the electrolysis time per pass. However, if the electrolysis time is excessively short, the line speed needs to be increased accordingly, making its control difficult. Therefore, the electrolysis time per pass is preferably 0.005 seconds or more, and more preferably 0.01 seconds or more.

The thickness of the metallic Cr layer formed by the cathodic electrolysis treatment can be controlled by the total electrical density, expressed as the product of the current density, the electrolysis time, and the number of passes. As described above, if the metallic Cr layer is excessively thick, the water contact angle may increase to impair the adhesion. From the viewpoint of more stably ensuring the adhesion, it is preferable to control the total electrical density so that the thickness of the metallic Cr layer is 100 nm or less. However, the relationship between the thickness of the metallic Cr layer and the total electrical density varies with the configuration of the device used in the cathodic electrolysis treatment process. Thus, the actual electrolysis treatment conditions may be adjusted according to the device.

The type of the anode used when performing the cathodic electrolysis treatment is not particularly limited, and any anode can be used. It is preferable to use an insoluble anode as the anode. As the insoluble anode, it is preferable to use at least one selected from the group consisting of an anode obtained by coating Ti with one or both of a platinum group metal and an oxide of the platinum group metal, and a graphite anode. More specifically, an example of the insoluble anode is an anode obtained by coating the surface of Ti as a substrate with platinum, iridium oxide, or ruthenium oxide.

In the above cathodic treatment process, the concentration of the electrolyte is constantly changing due to the formation of the metallic Cr layer and the Cr oxide layer on the steel sheet, bringing in and out of the solution, and evaporation of water. The change in concentration of the electrolyte in the cathodic electrolysis treatment process vary with the configuration of the device and production conditions. Thus, from the viewpoint of more stably producing the surface-treated steel sheet, it is preferable to monitor the concentration of the components contained in the electrolyte and maintain it in the above concentration range during the cathodic electrolysis treatment process.

The steel sheet having the Sn plating layer can be optionally pretreated prior to the cathodic electrolysis treatment. The pretreatment can remove the natural oxide film present on the surface of the Sn plating layer to activate the surface.

The method of the pretreatment is not particularly limited, and any method can be used. However, it is preferable to perform one or both of electrolysis treatment in an alkaline aqueous solution and immersion treatment in an alkaline aqueous solution, as the pretreatment. One or both of cathodic electrolysis treatment and anodic electrolysis treatment can be used as the electrolysis treatment. However, the electrolysis treatment preferably includes at least cathodic electrolysis treatment. From the viewpoint of reducing the Sn oxide content, it is preferable to perform any of the following treatments (1) to (3) as the pretreatment. Among them, it is more preferable to perform the treatment (1) or (2), and it is further preferable to perform the treatment (1).

(1) Cathodic electrolysis treatment in alkaline aqueous solution
(2) Immersion treatment in alkaline aqueous solution
(3) Cathodic electrolysis treatment in alkaline aqueous solution and subsequent anodic electrolysis treatment in alkaline aqueous solution The alkaline aqueous solution may contain one or two or more optional electrolytes. Any electrolyte may be used without any particular limitation. For example, it is preferable to use carbonate as the electrolyte, and it is more preferable to use sodium carbonate. The concentration of the alkaline aqueous solution is not particularly limited. However, it is preferably 1 g/L or more and 30 g/L or less, and more preferably 5 g/L or more and 20 g/L or less.

The temperature of the alkaline aqueous solution is not particularly limited. However, it is preferably 10° C. or more and 70° C. or less, and more preferably 15° C. or more and 60° C. or less.

When performing cathodic electrolysis treatment as the pretreatment, no particular lower limit is placed on the electric density in the cathodic electrolysis treatment. However, it is preferably 0.5 C/dm$^2$ or more, and more preferably 1.0 C/dm$^2$ or more. On the other hand, no particular upper limit is also placed on the electric density in the cathodic electrolysis treatment. However, an excessively high electric density saturates the effect of the pretreatment. Thus, the electric density is preferably 10.0 C/dm$^2$ or less.

When performing immersion treatment as the pretreatment, no particular lower limit is placed on the immersion time in the immersion treatment. However, it is preferably 0.1 seconds or more, and more preferably 0.5 seconds or more. On the other hand, no particular upper limit is also placed on the immersion time. However, an excessively long immersion time saturates the effect of the pretreatment. Thus, the immersion time is preferably 10 seconds or less.

When performing anodic electrolysis treatment after cathodic electrolysis treatment as the pretreatment, no particular lower limit is placed on the electric density in the anodic electrolysis treatment. However, it is preferably 0.5 $C/dm^2$ or more, and more preferably 1.0 $C/dm^2$ or more. On the other hand, no particular upper limit is also placed on the electric density in the anodic electrolysis treatment. However, an excessively high electric density saturates the effect of the pretreatment. Thus, the electric density is preferably 10.0 $C/dm^2$ or less.

After performing the pretreatment, it is preferable to perform water washing from the viewpoint of removing the pretreatment solution adhering to the surface.

When forming the Sn plating layer on the surface of the base steel sheet, it is preferable to perform pretreatment on the base steel sheet. Any treatment can be performed as the pretreatment. However, it is preferable to perform at least one of degreasing, acid cleaning, and water washing.

Degreasing can remove rolling oil, antirust oil, etc. attached to the steel sheet. The degreasing can be performed by any method with no particular limitation. After the degreasing, it is preferable to perform water washing to remove the degreasing treatment solution attached to the steel sheet surface.

Acid cleaning can remove the natural oxide film present on the surface of the steel sheet to activate the surface. The acid cleaning can be performed by any method with no particular limitation. After the acid cleaning, it is preferable to perform water washing to remove the acid cleaning solution attached to the steel sheet surface.

[Water Washing Process]

Next, the steel sheet after the above cathodic electrolysis treatment is subjected to water washing at least once. Water washing can remove the electrolyte remaining on the surface of the steel sheet. The water washing can be performed by any method with no particular limitation. For example, a water washing tank can be installed downstream of the electrolytic cell for performing the cathodic electrolysis treatment to continuously immerse the steel sheet after the cathodic electrolysis treatment in water. The water washing may also be performed by spraying water on the steel sheet after the cathodic electrolysis treatment with a spray.

The number of times water washing is performed is not particularly limited and may be one, or two or more. However, to avoid an excessively large number of water washing tanks, the number of times of water washing is preferably 5 or less. If water washing treatment is performed twice or more, each water washing may be performed in the same or different manner.

In this disclosure, it is important to use water with an electrical conductivity of 100 μS/m or less for at least the last water washing in the water washing treatment process. This can reduce the amount of K, Na, Mg, and Ca adsorbed on the surface of the surface-treated steel sheet, resulting in the improved adhesion. The water with an electrical conductivity of 100 μS/m or less can be produced by any method. The water with an electrical conductivity of 100 μS/m or less may be, for example, ion-exchanged water or distilled water.

When water washing is performed twice or more in the water washing treatment process, the above effect can be obtained by using the water with an electrical conductivity of 100 μS/m or less for the last water washing. Thus, any water can be used for the water washing other than the last water washing. The water with an electrical conductivity of 100 μS/m or less may be also used for the water washing other than the last water washing. However, from the viewpoint of cost reduction, it is preferable to use the water with an electrical conductivity of 100 μS/m or less only for the last water washing and to use normal water, such as tap water or industrial water, for the water washing other than the last water washing.

From the viewpoint of further reducing the amount of K, Na, Mg, and Ca adsorbed on the surface of the surface-treated steel sheet, the electrical conductivity of the water used for the last water washing is preferably 50 μS/m or less, and more preferably 30 μS/m or less.

The temperature of the water used for the water washing treatment is not particularly limited and may be any temperature. However, excessively high temperatures place an excessive burden on water washing equipment. Thus, the temperature of the water used for water washing is preferably 95° C. or less. On the other hand, no particular lower limit is also placed on the temperature of the water used for water washing. However, it is preferably 0° C. or more. The temperature of the water used for water washing may be room temperature.

The water washing time per water washing treatment is not particularly limited. However, from the viewpoint of increasing the effect of the water washing treatment, it is preferably 0.1 seconds or more, and more preferably 0.2 seconds or more. No particular upper limit is also placed on the water washing time per water washing treatment. However, at the production on a continuous line, it is preferably 10 seconds or less, and more preferably 8 seconds or less because the line speed is reduced to decrease the productivity.

After the above water washing treatment process, drying may be optionally performed. The drying method is not particularly limited. For example, ordinary dryer or electric furnace drying methods can be applied. The temperature for the drying process is preferably 100° C. or less. The temperature within the above range can suppress the transformation of the surface-coating layer. No particular lower limit is placed. However, it is usually around room temperature.

The applications of the surface-treated steel sheet of this disclosure are not particularly limited. However, the surface-treated steel sheet is particularly suitable as a surface-treated steel sheet for container used in the production of various types of containers, such as food cans, beverage cans, pails, and 18-liter cans.

Examples

To determine the effect of this disclosure, surface-treated steel sheets were produced in the following procedures and their characteristics were evaluated.

(Electrolyte Preparation Process)

First, electrolytes having compositions A to G presented in Table 1 were prepared under the respective conditions presented in Table 1. That is, the respective components presented in Table 1 were mixed with water to form aqueous solutions, and then each aqueous solution was adjusted to the pH and the temperature presented in Table 1. Electrolyte G is equivalent to the electrolyte used in the example in PTL 4. For increasing the pH, ammonia water was used in each case. For decreasing the pH, sulfuric acid was used for Electrolytes A, B, and G, hydrochloric acid was used for Electrolytes C and D, and nitric acid was used for Electrolytes E and F.

(Sn Plating)

On the other hand, after electrolytic degreasing, water washing, acid cleaning by immersion in dilute sulfuric acid, and water washing were sequentially performed on each steel sheet, Sn electroplating was performed using a phenolsulfonic acid bath to form Sn plating layers on both surfaces of the steel sheet. In this case, the Sn coating weight of the Sn plating layer was set to each value presented in Tables 2 and 4 by changing the current passage time. In some examples, prior to the Sn electroplating, the steel sheet was subjected to Ni electroplating using a Watts bath to form Ni plating layers as Ni-containing layers on both surfaces of the steel sheet. In this case, the Ni coating weight of the Ni plating layer was set to each value presented in Tables 2 and 4 by changing the current passage time and the current density. Furthermore, in some examples, reflow treatment was performed after forming the Sn plating layer. In the reflow treatment, the steel sheet was heated at a heating rate of 50° C./sec for 5 seconds by direct current heating method and then rapidly cooled by introducing the steel sheet into water.

As each steel sheet, a steel sheet for can (T4 base sheet) was used, having a Cr content of each value presented in Tables 2 and 4 and a thickness of 0.22 mm.

(Pretreatment on Sn Plating Steel Sheet)

Subsequently, each resulting Sn plating steel sheet was subjected to each pretreatment presented in Tables 2 and 4. A sodium carbonate aqueous solution with a concentration of 10 g/L was used for each of the cathodic electrolysis treatment, the anodic electrolysis treatment, and the immersion treatment in the pretreatment. The temperature of the sodium carbonate aqueous solution was room temperature. The electric density during the cathodic electrolysis treatment was set to 2.0 C/dm$^2$. The electric density during the anodic electrolysis treatment was set to 4.0 C/dm$^2$. The immersion time in the immersion treatment was set to 1 second. For comparison, no pretreatment was performed in some examples.

(Cathodic Electrolysis Treatment Process)

Next, each Sn plating steel sheet was subjected to the cathodic electrolysis treatment under each conditions presented in Tables 2 and 4. Each electrolyte in the cathodic electrolysis treatment was maintained at each pH and temperature presented in Table 1. The electrical density during the cathodic electrolysis treatment was set at 40 A/dm$^2$, and the electrolysis time and the number of passes were appropriately varied. An insoluble anode obtained by coating Ti as a substrate with iridium oxide was used as the anode during the cathodic electrolysis treatment. After the cathodic electrolysis treatment was performed, each steel sheet was subjected to the water washing treatment and then dried at room temperature using a blower.

(Water Washing Process)

Next, each steel sheet after the above cathodic electrolysis treatment was subjected to the water washing treatment. The water washing treatment was performed one time to five times under each conditions presented in Tables 2 and 4. The method of each water washing and the electrical conductivity of the used water are presented in Tables 2 and 4.

For each of the obtained surface-treated steel sheets, the thickness of the Cr oxide layer, the thickness of the metallic Cr layer, the water contact angle, the atomic ratio of adsorbed element, the Sn atomic ratio, and the Sn oxide content were measured using the following procedures. The measurement results are presented in Tables 3 and 5.

(Thickness of Cr Oxide Layer)

The thickness of the Cr oxide layer was measured by XPS. Specifically, the Cr2p narrow spectrum was separated into three peaks each corresponding to metallic Cr, Cr oxide, and Cr hydroxide from the lowest bonding energy, to calculate the integrated intensity ratio. The measurement was taken every 2 nm from the topmost layer until the sum of the integrated intensities of the Cr oxide peak and the Cr hydroxide peak became less than the integrated intensity of the metallic Cr peak. The relationship of integrated intensity of metallic Cr peak/(integrated intensity of Cr oxide peak+integrated intensity of Cr hydroxide peak) with respect to the depth from the topmost layer was linearly approximated using the least-squares method. Then, the depth from the topmost layer where integrated intensity of metallic Cr peak/(integrated intensity of Cr oxide peak+integrated intensity of Cr hydroxide peak) is 1 was defined as the thickness of the Cr oxide layer. The Cr2p narrow spectrum may include peaks corresponding to the bonding energy of C and Cr co-deposited in the metallic Cr layer and the Cr oxide layer. However, it is perfectly acceptable to ignore the peaks corresponding to the bonding energy of C and Cr and separate the Cr2p narrow spectrum into the above three peaks to calculate each thickness of the metallic Cr layer and the Cr oxide layer.

(Thickness of Metallic Cr Layer)

The thickness of the metallic Cr layer was also measured by XPS, similarly to the Cr oxide layer. Specifically, the atomic ratios were quantified by the relative sensitivity factor method from the integral intensity of the Cr2p and Sn3d narrow spectra, and then the measurement was taken every 2 nm from the topmost layer until the Cr atomic ratio became smaller than the Sn atomic ratio. The relationship of Sn atomic ratio/Cr atomic ratio with respect to the depth from the topmost layer was approximated by a cubic formula using the least-squares method. Then, the value obtained by subtracting the thickness of the Cr oxide layer from the depth from the topmost layer where Sn atomic ratio/Cr atomic ratio is 1 was defined as the thickness of the metallic Cr layer. The case where the depth from the topmost layer where above Sn atom ratio/Cr atom ratio is 1 is smaller than the above thickness of the Cr oxide layer means that there is no metallic Cr layer, in which case, sufficient sulfide staining resistance cannot be obtained.

For the above measurement of the thickness of the Cr oxide layer and the thickness of the metallic Cr layer, a scanning X-ray photoelectron spectrometer PHI X-tool made by ULVAC-PHI was used. The X-ray source was monochrome AlKα ray, the voltage was 15 kV, the beam diameter was 100 μmφ, and the extraction angle was 45°. The sputtering conditions are Ar ions at an accelerating voltage of 1 kV, and the sputtering rate is 1.50 nm/min in terms of $SiO_2$. For separation into three peaks corresponding to metallic Cr, Cr oxide, and Cr hydroxide, analysis software MultiPak made by ULVAC-PHI was used, background processing by the IntrratedShirley method was performed, and peak fitting by the Gauss-Lorentz function was performed. In the peak fitting, Position, FWHM, and % Gauss were entered for each peak to match the spectrum to perform auto-fitting. If the auto-fitting did not converge, the above values were varied until the auto-fitting converged.

(Water Contact Angle)

The water contact angle was measured using an automatic contact angle meter CA-VP model made by Kyowa Surfaces & Technologies. The surface temperature of the surface-treated steel sheet was set to 20° C.±1° C., and distilled water at 20° C.±1° C. was used as water. The distilled water was dropped onto the surface of the surface-treated steel sheet in a 2-μl volume. After 1 second, the contact angle was measured by the θ/2 method. The arithmetic mean value of the contact angle for five drops was defined as the water contact angle.

(Atomic Ratio of Adsorbed Element)

The total atomic ratio of K, Na, Mg, and Ca adsorbed on the surface of the surface-treated steel sheet to Cr was measured by XPS. No sputtering was performed in the measurement. The atomic ratios were quantified by the relative sensitivity factor method from the integrated intensity of the narrow spectra of K2p, Na1s, Ca2p, Mg1s, and Cr2p at the topmost surface of the sample to calculate (K atomic ratio+Na atomic ratio+Ca atomic ratio+Mg atomic ratio)/Cr atomic ratio. For the XPS measurement, a scanning X-ray photoelectron spectrometer PHI X-tool made by ULVAC-PHI was used. The X-ray source was monochrome AlKα ray, the voltage was 15 kV, the beam diameter was 100 μmφ, and the extraction angle was 45°.

(Sn Atom Ratio)

The atomic ratio of Sn content to Cr on the surface of the surface-treated steel sheet was measured by XPS. No sputtering was performed in the measurement. The atomic ratios were quantified by the relative sensitivity factor method from the integrated intensity of the Sn3d and Cr2p narrow spectra at the topmost surface of the sample to calculate Sn atomic ratio/Cr atomic ratio. For the XPS measurement, a scanning X-ray photoelectron spectrometer PHI X-tool made by ULVAC-PHI was used. The X-ray source was monochrome AlKα ray, the voltage was 15 kV, the beam diameter was 100 μmφ, and the extraction angle was 45°.

(Sn Oxide Content)

The Sn oxide content was measured from the current-potential curve obtained by immersing the finally obtained surface-treated steel sheet in a 0.001 N hydrogen bromide aqueous solution at 25° C., which had been replaced with Ar gas, using a saturated KCl—Ag/AgCl electrode as a reference electrode and a platinum plate as a counter electrode, and sweeping the potential from the immersion potential to the negative side at a sweep rate of 1 mV/sec. The electrical quantity obtained by integrating the reduction currents in the potential range of −600 mV to −400 mV in the current-potential curve vs the saturated KCl—Ag/AgCl reference electrode was defined as the Sn oxide content.

Furthermore, the resulting surface-treated steel sheets were evaluated for the sulfide staining resistance and the coating secondary adhesion by the following methods. The evaluation results are presented in Tables 3 and 5.

(Sulfide Staining Resistance)

After the surface of each surface-treated steel sheet produced by the above method was coated with a commercial epoxy resin coating material for cans at a dry mass of 60 mg/dm$^2$, the steel sheet was baked at 200° C. for 10 minutes and then left at room temperature for 24 hours. Each resulting steel sheet was then cut to a predetermined size. An aqueous solution containing anhydrous disodium hydrogen phosphate: 7.1 g/L, anhydrous sodium dihydrogen phosphate: 3.0 g/L, and L-cysteine hydrochloride: 6.0 g/L was prepared, boiled for 1 hour. Then, the aqueous solution was diluted with pure water by the volume reduced by evaporation. The resulting aqueous solution was poured into a pressure-resistant, heat-resistant container made of Teflon® (Teflon is a registered trademark in Japan, other countries, or both), the steel plate cut to a predetermined size was immersed in the aqueous solution, and then the lid of the container was closed and sealed. The sealed container was subjected to retort treatment at a temperature of 131° C. for 60 minutes.

The appearance of the steel sheets after the above retort treatment was evaluated for the sulfide staining resistance. If the appearance did not change at all before and after the test, it was designated "◎"; if blackening of 10 area % or less occurred, it was designated "○"; if blackening of 20 area % or less and more than 10 area % occurred, it was designated "Δ"; and if blackening of more than 20 area % occurred, it was designated "x". For practical use, the evaluation of ◎, ○, and Δ was considered acceptable as excellent sulfide staining resistance.

(Coating Secondary Adhesion)

The surface of each resulting surface-treated steel sheet was coated with epoxy phenolic-based coating material and baked at 210° C. for 10 minutes to produce a coated steel sheet. The coating weight was 50 mg/dm$^2$.

Two coated steel sheets produced under the same conditions were laminated so that the coated surfaces faced one another with a nylon adhesive film in between, and then stacked under crimping conditions of a pressure of $2.94\times10^5$ Pa, a temperature of 190° C., and a crimping time of 30 seconds. It was then divided into specimens with 5 mm in width. The divided specimens were immersed in a test solution at 55° C. consisting of a mixed aqueous solution containing 1.5 mass % citric acid and 1.5 mass % salt for 168 hours. After immersion, washing and drying were performed. Then, the two steel sheets of the divided specimen were pulled apart in a tensile testing machine, and the tensile strength when pulled apart was measured. The average value of three specimens was evaluated using the following criteria. For practical use, a result of ◎, ○, or Δ can be evaluated as having excellent coating secondary adhesion.

◎: 2.5 kgf or more

○: 2.0 kgf or more and less than 2.5 kgf

Δ: 1.5 kgf or more and less than 2.0 kgf x: Less than 1.5 kgf

As is clear from the results presented in Tables 3 and 5, the surface-treated steel sheets meeting the conditions of this disclosure all had excellent sulfide staining resistance and coating secondary adhesion, even though they were produced without using hexavalent chromium.

TABLE 1

| | Electrolyte | A | B | C | D | E | F | G |
|---|---|---|---|---|---|---|---|---|
| Composition (mol/L) | $Cr(OH)SO_4 \cdot Na_2SO_4$ | — | — | — | — | — | — | 0.39 |
| | $Cr_2(SO_4)_3$ | 0.1 | 0.2 | — | — | — | — | — |
| | $CrCl_3$ | — | — | 0.2 | 0.5 | — | — | — |
| | $Cr(NO_3)_3$ | — | — | — | — | 0.2 | 0.5 | — |
| | $HCO_2H$ | 4.2 | — | 0.4 | — | 4.8 | — | — |
| | $NH_4CHO_2$ | — | 0.5 | — | 3.5 | — | 0.5 | — |
| | $HCO_2K$ | — | — | — | — | — | — | 0.61 |
| | $NH_4Cl$ | 1.1 | 1.4 | 0.7 | — | 1.5 | — | — |
| | $NH_4Br$ | — | 0.3 | 0.6 | 0.4 | 0.2 | 1.3 | — |
| | KCl | — | — | — | — | — | — | 3.35 |
| | KBr | — | — | — | — | — | — | 0.13 |
| pH | | 5.0 | 5.7 | 5.1 | 4.3 | 6.8 | 5.8 | 2.3 |
| Temperature (° C.) | | 42 | 50 | 65 | 55 | 55 | 53 | 50 |
| Remarks | | Example | Example | Example | Example | Example | Example | Comparative Example |

TABLE 2

| | Production conditions | | | | | | | | | |
|---|---|---|---|---|---|---|---|---|---|---|
| | | Sn plating | | | | Cathode electrolysis treatment | | Water washing treatment | | |
| | Steel sheet | | Ni coating | Sn coating | | | Electric | First time | | |
| No. | Cr content [%] | Reflow treatment | weight [mg/m$^2$] | weight [g/m$^2$] | Pretreatment | Electrolyte | density [C/dm$^2$] | Method | Conductivity [μS/m] | Second time Method |
| 1 | 0.04 | Yes | — | 5.6 | Cathodic electrolysis | A | 50 | Immersion | 22 | — |
| 2 | 0.04 | Yes | — | 2.8 | Cathodic electrolysis | D | 40 | Spray | 16 | — |
| 3 | 0.04 | Yes | — | 5.6 | Cathodic electrolysis | C | 110 | Spray | 103 | Immersion |
| 4 | 0.04 | Yes | — | 2.8 | Cathodic electrolysis | B | 20 | Spray | 62 | Spray |
| 5 | 0.04 | Yes | — | 5.6 | Cathodic electrolysis | F | 14 | Spray | 8 | Immersion |
| 6 | 0.04 | Yes | — | 2.8 | Cathodic electrolysis | E | 3.6 | Immersion | 16 | Immersion |
| 7 | 0.04 | Yes | — | 5.6 | Cathodic electrolysis | C | 28 | Spray | 103 | Immersion |
| 8 | 0.04 | Yes | — | 2.8 | Cathodic electrolysis | A | 12 | Immersion | 15 | Immersion |
| 9 | 0.04 | Yes | — | 5.6 | Cathodic electrolysis | D | 10 | Immersion | 29 | Immersion |
| 10 | 0.04 | Yes | — | 2.8 | Cathodic electrolysis | F | 16 | Immersion | 123 | Spray |
| 11 | 0.04 | Yes | — | 8.4 | Cathodic electrolysis | B | 6 | Immersion | 13 | Immersion |
| 12 | 0.04 | Yes | — | 11.2 | Cathodic electrolysis | E | 46 | Immersion | 83 | Spray |
| 13 | 0.04 | Yes | — | 2.8 | Cathodic electrolysis | A | 10 | Immersion | 108 | Immersion |
| 14 | 0.04 | Yes | — | 2.8 | Cathodic electrolysis | C | 16 | Immersion | 103 | Spray |
| 15 | 0.04 | Yes | 70 | 0.9 | Cathodic electrolysis | B | 6 | Immersion | 68 | Immersion |
| 16 | 0.04 | No | — | 2.8 | Cathodic electrolysis | A | 18 | Immersion | 38 | Immersion |
| 17 | 0.04 | No | 80 | 0.8 | Cathodic electrolysis | C | 5.6 | Immersion | 19 | Immersion |
| 18 | 0.04 | Yes | — | 2.8 | Cathodic electrolysis | E | 2 | Immersion | 11 | Immersion |
| 19 | 0.04 | Yes | — | 2.8 | Cathodic electrolysis | F | 0.8 | Immersion | 106 | Immersion |
| 20 | 0.04 | Yes | — | 2.8 | Cathodic electrolysis | D | 460 | Immersion | 22 | Immersion |
| 21 | 0.04 | Yes | — | 2.8 | Cathodic electrolysis | B | 500 | Immersion | 96 | Immersion |
| 22 | 0.04 | Yes | — | 5.6 | Cathodic electrolysis | A | 5.2 | Immersion | 33 | — |
| 23 | 0.04 | Yes | — | 2.8 | Cathodic electrolysis | C | 7.2 | Spray | 42 | — |
| 24 | 0.04 | Yes | — | 5.6 | Cathodic electrolysis | B | 32 | Immersion | 56 | — |
| 25 | 0.04 | Yes | — | 2.8 | Cathodic electrolysis | D | 54 | Spray | 72 | — |
| 26 | 0.04 | Yes | — | 5.6 | Cathodic electrolysis | E | 6.4 | Immersion | 103 | — |
| 27 | 0.04 | Yes | — | 2.8 | Cathodic electrolysis | F | 6.8 | Spray | 120 | — |
| 28 | 0.04 | Yes | — | 11.2 | Cathodic electrolysis | B | 8 | Immersion | 60 | Immersion |
| 29 | 0.04 | Yes | — | 2.8 | Cathodic electrolysis | A | 4 | Immersion | 21 | Spray |
| 30 | 0.04 | Yes | 70 | 0.9 | Cathodic electrolysis | E | 13.2 | Immersion | 33 | Immersion |
| 31 | 0.04 | No | — | 2.8 | Cathodic electrolysis | F | 10 | Immersion | 86 | Spray |
| 32 | 0.04 | Yes | 70 | 0.9 | Cathodic electrolysis | D | 12 | Immersion | 59 | Immersion |
| 33 | 0.04 | No | — | 2.8 | Cathodic electrolysis | C | 10 | Immersion | 102 | Spray |
| 34 | 0.04 | No | 80 | 0.8 | Cathodic electrolysis | D | 36 | Immersion | 203 | Immersion |

| | Production conditions Water washing treatment | | | | | | | |
|---|---|---|---|---|---|---|---|---|
| | Second time | | Third time | | Fourth time | | Fifth time | |
| No. | Conductivity [μS/m] | Method | Conductivity [μS/m] | Method | Conductivity [μS/m] | Method | Conductivity [μS/m] | Remarks |
| 1 | — | — | — | — | — | — | — | Example |
| 2 | — | — | — | — | — | — | — | Example |
| 3 | 14 | — | — | — | — | — | — | Example |
| 4 | 11 | — | — | — | — | — | — | Example |
| 5 | 33 | Immersion | 18 | — | — | — | — | Example |
| 6 | 5 | Spray | 6 | — | — | — | — | Example |
| 7 | 42 | Immersion | 206 | Immersion | 5 | — | — | Example |
| 8 | 33 | Spray | 201 | Spray | 12 | — | — | Example |
| 9 | 16 | Immersion | 207 | Immersion | 60 | Immersion | 28 | Example |
| 10 | 62 | Spray | 22 | Immersion | 120 | Spray | 26 | Example |
| 11 | 201 | Spray | 16 | — | — | — | — | Example |
| 12 | 105 | Spray | 24 | — | — | — | — | Example |
| 13 | 106 | Immersion | 27 | — | — | — | — | Example |
| 14 | 62 | Spray | 22 | — | — | — | — | Example |
| 15 | 39 | Spray | 19 | — | — | — | — | Example |
| 16 | 95 | Immersion | 9 | — | — | — | — | Example |
| 17 | 62 | Spray | 23 | — | — | — | — | Example |
| 18 | 13 | Immersion | 22 | — | — | — | — | Example |
| 19 | 174 | Spray | 19 | — | — | — | — | Example |
| 20 | 31 | Immersion | 16 | — | — | — | — | Example |
| 21 | 152 | Spray | 23 | — | — | — | — | Example |
| 22 | — | — | — | — | — | — | — | Example |
| 23 | — | — | — | — | — | — | — | Example |

TABLE 2-continued

| | | | | | | | | |
|---|---|---|---|---|---|---|---|---|
| 24 | — | — | — | — | — | — | — | Example |
| 25 | — | — | — | — | — | — | — | Example |
| 26 | — | — | — | — | — | — | — | Comparative Example |
| 27 | — | — | — | — | — | — | — | Comparative Example |
| 28 | 46 | — | — | — | — | — | — | Example |
| 29 | 32 | — | — | — | — | — | — | Example |
| 30 | 63 | — | — | — | — | — | — | Example |
| 31 | 89 | — | — | — | — | — | — | Example |
| 32 | 131 | — | — | — | — | — | — | Comparative Example |
| 33 | 181 | — | — | — | — | — | — | Comparative Example |
| 34 | 16 | Immersion | 39 | — | — | — | — | Example |

TABLE 3

| | Measurement result | | | | | | Evaluation | | |
|---|---|---|---|---|---|---|---|---|---|
| No. | Metallic Cr layer Thickness [nm] | Cr oxide layer Thickness [nm] | Water contact angle [°] | Atomic ratio of adsorbed element *1 [%] | Sn atom ratio *2 [%] | Sn oxide content [mC/cm$^2$] | Sulfide staining resistance | Coating secondary adhesion | Remarks |
| 1 | 9.8 | 2.3 | 19.3 | 0.0 | 32.1 | 2.3 | ◎ | ◎ | Example |
| 2 | 0.5 | 15.0 | 20.6 | 0.0 | 16.3 | 2.1 | ◎ | ◎ | Example |
| 3 | 22.6 | 1.6 | 16.9 | 0.2 | 48.2 | 1.3 | ◎ | ◎ | Example |
| 4 | 0.9 | 6.3 | 41.6 | 0.0 | 59.3 | 2.9 | ◎ | ◎ | Example |
| 5 | 2.9 | 3.2 | 30.3 | 0.0 | 36.6 | 2.3 | ◎ | ◎ | Example |
| 6 | 0.7 | 1.8 | 9.6 | 0.0 | 55.3 | 2.5 | ◎ | ◎ | Example |
| 7 | 5.3 | 1.9 | 11.6 | 0.0 | 27.1 | 2.4 | ◎ | ◎ | Example |
| 8 | 0.6 | 13.6 | 25.6 | 0.0 | 49.3 | 2.6 | ◎ | ◎ | Example |
| 9 | 0.8 | 7.6 | 17.2 | 0.3 | 32.3 | 2.9 | ◎ | ◎ | Example |
| 10 | 3.2 | 0.8 | 21.0 | 0.4 | 45.5 | 3.0 | ◎ | ◎ | Example |
| 11 | 1.1 | 1.0 | 39.6 | 0.0 | 12.2 | 2.6 | ◎ | ◎ | Example |
| 12 | 8.6 | 0.5 | 43.5 | 0.2 | 6.3 | 2.1 | ◎ | ◎ | Example |
| 13 | 1.8 | 1.6 | 31.3 | 0.0 | 19.6 | 2.8 | ◎ | ◎ | Example |
| 14 | 3.2 | 2.3 | 21.0 | 0.1 | 54.8 | 1.9 | ◎ | ◎ | Example |
| 15 | 0.6 | 8.3 | 23.3 | 0.0 | 41.6 | 2.3 | ◎ | ◎ | Example |
| 16 | 0.7 | 12.6 | 16.6 | 0.0 | 39.5 | 2.2 | ◎ | ◎ | Example |
| 17 | 1.1 | 2.6 | 19.2 | 0.0 | 22.6 | 2.1 | ◎ | ◎ | Example |
| 18 | 0.4 | 1.5 | 14.3 | 0.0 | 55.5 | 2.6 | ○ | ◎ | Example |
| 19 | 0.2 | 2.7 | 15.5 | 0.0 | 51.6 | 2.8 | Δ | ◎ | Example |
| 20 | 83.6 | 3.3 | 47.2 | 0.0 | 4.6 | 2.3 | ◎ | ○ | Example |
| 21 | 94.2 | 2.2 | 49.6 | 0.0 | 8.9 | 2.1 | ◎ | Δ | Example |
| 22 | 1.0 | 3.4 | 13.3 | 1.2 | 24.3 | 2.6 | ○ | ○ | Example |
| 23 | 1.3 | 2.6 | 15.6 | 2.6 | 19.6 | 2.5 | ○ | ○ | Example |
| 24 | 6.5 | 1.9 | 17.8 | 3.3 | 33.6 | 2.3 | Δ | Δ | Example |
| 25 | 10.6 | 8.9 | 22.3 | 3.9 | 11.6 | 2.5 | Δ | Δ | Example |
| 26 | 1.3 | 2.9 | 7.9 | 5.1 | 39.6 | 2.5 | X | X | Comparative Example |
| 27 | 1.4 | 2.4 | 10.2 | 6.2 | 48.3 | 2.3 | X | X | Comparative Example |
| 28 | 1.6 | 1.2 | 16.1 | 1.6 | 22.9 | 2.1 | ○ | ○ | Example |
| 29 | 0.8 | 3.9 | 17.2 | 2.2 | 36.3 | 1.2 | ○ | ○ | Example |
| 30 | 2.6 | 2.6 | 23.6 | 3.5 | 22.7 | 1.6 | Δ | Δ | Example |
| 31 | 1.9 | 4.4 | 24.2 | 4.5 | 33.6 | 2.1 | Δ | Δ | Example |
| 32 | 2.4 | 3.6 | 19.3 | 6.3 | 14.6 | 2.9 | X | X | Comparative Example |
| 33 | 1.9 | 3.5 | 22.3 | 6.6 | 55.3 | 3.0 | X | X | Comparative Example |
| 34 | 6.8 | 2.6 | 22.1 | 1.4 | 13.5 | 1.3 | ○ | ○ | Example |

*1 Total atomic ratio of K, Na, Mg, and Ca adsorbed on the surface to Cr

*2 Atomic ratio of Sn on the surface to Cr

TABLE 4

| Production conditions | | | | | | | | | | |
|---|---|---|---|---|---|---|---|---|---|---|
| | Production conditions | | | | | | | | | |
| | | Sn plating | | | | Cathode electrolysis treatment | | Water washing treatment | | |
| | | | Ni | Sn | | | | First time | | |
| No. | Steel sheet Cr content [%] | Reflow treatment | coating weight [mg/m$^2$] | coating weight [g/m$^2$] | Pretreatment | Electrolyte | Electric density [C/dm$^2$] | Method | Conductivity [μS/m] | Second time Method |
| 35 | 0.04 | Yes | — | 2.8 | Cathodic electrolysis | C | 50 | Spray | 13 | Immersion |
| 36 | 0.04 | Yes | — | 2.8 | Cathodic electrolysis | E | 110 | Immersion | 32 | Spray |
| 37 | 0.04 | Yes | — | 2.8 | Cathodic electrolysis | F | 10 | Immersion | 46 | Immersion |
| 38 | 0.04 | Yes | — | 2.8 | Cathodic electrolysis | A | 86 | Immersion | 32 | Spray |
| 39 | 0.04 | Yes | — | 2.8 | Cathodic electrolysis | B | 16 | Immersion | 16 | Immersion |
| 40 | 0.04 | Yes | — | 2.8 | Cathodic electrolysis | A | 10 | Immersion | 9 | Immersion |
| 41 | 0.04 | Yes | — | 2.8 | Cathodic electrolysis | C | 28 | Immersion | 26 | Spray |
| 42 | 0.04 | Yes | — | 2.8 | Cathodic electrolysis | B | 64 | Immersion | 76 | Immersion |
| 43 | 0.04 | Yes | — | 2.8 | Cathodic electrolysis | F | 8 | Spray | 32 | Immersion |
| 44 | 0.04 | Yes | — | 2.8 | Cathodic electrolysis | D | 4 | Immersion | 81 | Immersion |
| 45 | 0.04 | Yes | — | 2.8 | Cathodic electrolysis | E | 56 | Spray | 59 | Immersion |
| 46 | 0.04 | Yes | — | 2.8 | Cathodic electrolysis | B | 32 | Immersion | 19 | Spray |
| 47 | 0.04 | Yes | — | 2.8 | Cathodic electrolysis | F | 16 | Immersion | 102 | Spray |
| 48 | 0.04 | Yes | — | 2.8 | Cathodic electrolysis | A | 7.6 | Immersion | 36 | Immersion |
| 49 | 0.04 | Yes | — | 2.8 | Cathodic electrolysis | C | 4.8 | Immersion | 9 | Immersion |
| 50 | 0.04 | Yes | — | 2.8 | Cathodic electrolysis | E | 7.2 | Immersion | 33 | Immersion |
| 51 | 0.04 | Yes | — | 2.8 | Cathodic electrolysis | D | 3.2 | Immersion | 64 | Immersion |
| 52 | 0.04 | Yes | — | 2.8 | Cathodic electrolysis | B | 6 | No water washing | — | — |
| 53 | 0.04 | Yes | — | 2.8 | Cathodic electrolysis | G | 16 | Immersion | 49 | Immersion |
| 54 | 0.04 | Yes | — | 2.8 | Cathodic electrolysis | G | 48 | Immersion | 32 | Spray |
| 55 | 0.09 | Yes | — | 2.8 | Cathodic electrolysis | B | 20 | Spray | 62 | Spray |
| 56 | 0.12 | Yes | — | 2.8 | Cathodic electrolysis | B | 20 | Spray | 62 | Spray |
| 57 | 0.04 | Yes | — | 2.8 | Immersion | B | 20 | Spray | 62 | Spray |
| 58 | 0.04 | Yes | — | 2.8 | None | B | 20 | Spray | 62 | Spray |
| 59 | 0.04 | Yes | — | 2.8 | Cathodic electrolysis → Anodic electrolysis | B | 20 | Spray | 62 | Spray |
| 60 | 0.04 | Yes | 3 | 0.5 | Cathodic electrolysis | A | 20 | Immersion | 53 | Spray |
| 61 | 0.04 | Yes | 5 | 0.6 | Cathodic electrolysis | C | 40 | Immersion | 49 | Spray |
| 62 | 0.04 | Yes | 11 | 1.0 | Cathodic electrolysis | B | 12 | Immersion | 24 | Spray |
| 63 | 0.04 | Yes | 43 | 0.4 | Cathodic electrolysis | D | 16 | Immersion | 31 | Spray |
| 64 | 0.04 | Yes | 121 | 0.3 | Cathodic electrolysis | F | 20 | Immersion | 13 | Spray |
| 65 | 0.04 | No | 16 | 0.8 | Cathodic electrolysis | E | 12 | Immersion | 25 | Spray |

| Production conditions Water washing treatment | | | | | | | | |
|---|---|---|---|---|---|---|---|---|
| | Second time | | Third time | | Fourth time | | Fifth time | |
| No. | Conductivity [μS/m] | Method | Conductivity [μS/m] | Method | Conductivity [μS/m] | Method | Conductivity [μS/m] | Remarks |
| 35 | 19 | Spray | 49 | — | — | — | — | Example |
| 36 | 206 | Immersion | 96 | — | — | — | — | Example |
| 37 | 33 | Spray | 77 | — | — | — | — | Example |
| 38 | 206 | Immersion | 136 | — | — | — | — | Comparative Example |
| 39 | 56 | Spray | 203 | — | — | — | — | Comparative Example |
| 40 | 43 | Spray | 33 | Immersion | 40 | — | — | Example |
| 41 | 53 | Immersion | 142 | Spray | 47 | — | — | Example |
| 42 | 55 | Spray | 35 | Immersion | 59 | — | — | Example |
| 43 | 9 | Spray | 19 | Spray | 61 | — | — | Example |
| 44 | 35 | Spray | 11 | Immersion | 162 | — | — | Comparative Example |
| 45 | 13 | Spray | 9 | Spray | 113 | — | — | Comparative Example |
| 46 | 26 | Spray | 16 | Immersion | 11 | Immersion | 36 | Example |
| 47 | 13 | Immersion | 30 | Immersion | 43 | Spray | 38 | Example |
| 48 | 19 | Spray | 52 | Immersion | 8 | Immersion | 53 | Example |
| 49 | 12 | Spray | 103 | Immersion | 59 | Spray | 98 | Example |
| 50 | 79 | Spray | 36 | Immersion | 15 | Immersion | 163 | Comparative Example |
| 51 | 21 | Spray | 107 | Immersion | 12 | Spray | 191 | Comparative Example |
| 52 | — | — | — | — | — | — | — | Comparative Example |
| 53 | 26 | Spray | 14 | — | — | — | — | Comparative Example |
| 54 | 16 | Immersion | 24 | — | — | — | — | Comparative Example |
| 55 | 11 | — | — | — | — | — | — | Example |
| 56 | 11 | — | — | — | — | — | — | Example |
| 57 | 11 | — | — | — | — | — | — | Example |
| 58 | 11 | — | — | — | — | — | — | Example |
| 59 | 11 | — | — | — | — | — | — | Example |

TABLE 4-continued

| | | | | | | | | |
|---|---|---|---|---|---|---|---|---|
| | | | | Production conditions | | | | |
| 60 | 21 | — | — | — | — | — | — | Example |
| 61 | 16 | — | — | — | — | — | — | Example |
| 62 | 8 | — | — | — | — | — | — | Example |
| 63 | 13 | — | — | — | — | — | — | Example |
| 64 | 26 | — | — | — | — | — | — | Example |
| 65 | 11 | — | — | — | — | — | — | Example |

TABLE 5

| | Measurement result | | | | | | Evaluation | | |
|---|---|---|---|---|---|---|---|---|---|
| No. | Metallic Cr layer Thickness [nm] | Cr oxide layer Thickness [nm] | Water contact angle [°] | Atomic ratio of adsorbed element *1 [%] | Sn atom ratio *2 [%] | Sn oxide content [mC/cm$^2$] | Sulfide staining resistance | Coating secondary adhesion | Remarks |
| 35 | 10.2 | 1.3 | 19.3 | 2.9 | 22.6 | 2.3 | ○ | ○ | Example |
| 36 | 22.5 | 4.8 | 33.6 | 3.6 | 39.3 | 2.5 | Δ | Δ | Example |
| 37 | 2.0 | 2.6 | 41.3 | 3.9 | 16.5 | 2.1 | Δ | Δ | Example |
| 38 | 17.0 | 3.8 | 15.6 | 5.8 | 7.3 | 1.8 | X | X | Comparative Example |
| 39 | 3.2 | 2.3 | 18.3 | 6.7 | 9.2 | 1.4 | X | X | Comparative Example |
| 40 | 1.9 | 4.3 | 43.9 | 1.3 | 16.3 | 2.6 | ○ | ○ | Example |
| 41 | 5.6 | 1.9 | 22.6 | 2.2 | 22.4 | 2.3 | ○ | ○ | Example |
| 42 | 13.2 | 2.6 | 16.3 | 3.3 | 12.2 | 2.6 | Δ | Δ | Example |
| 43 | 1.5 | 3.6 | 30.6 | 3.4 | 54.0 | 2.7 | Δ | Δ | Example |
| 44 | 0.8 | 2.7 | 12.3 | 5.6 | 13.2 | 2.9 | X | X | Comparative Example |
| 45 | 11.1 | 4.2 | 15.6 | 5.2 | 39.3 | 2.5 | X | X | Comparative Example |
| 46 | 6.8 | 3.7 | 33.6 | 1.1 | 42.1 | 2.2 | ○ | ○ | Example |
| 47 | 3.2 | 1.2 | 23.3 | 2.3 | 55.3 | 2.5 | ○ | ○ | Example |
| 48 | 1.5 | 1.1 | 11.6 | 3.1 | 44.2 | 2.9 | Δ | Δ | Example |
| 49 | 0.9 | 1.3 | 11.3 | 4.8 | 39.6 | 2.8 | Δ | Δ | Example |
| 50 | 1.4 | 1.9 | 16.5 | 5.6 | 33.6 | 2.4 | X | X | Comparative Example |
| 51 | 0.6 | 1.5 | 11.2 | 5.8 | 42.2 | 2.6 | X | X | Comparative Example |
| 52 | 1.2 | 2.6 | 71.3 | 0.6 | 2.9 | 2.6 | X | X | Comparative Example |
| 53 | — | — | 69.2 | 2.6 | 43.3 | 2.3 | ○ | X | Comparative Example |
| 54 | — | — | 63.6 | 0.9 | 32.6 | 2.7 | ○ | X | Comparative Example |
| 55 | 1.0 | 5.1 | 40.3 | 0.0 | 83.6 | 2.6 | ○ | ○ | Example |
| 56 | 0.9 | 3.6 | 34.2 | 0.0 | 103.2 | 2.8 | Δ | Δ | Example |
| 57 | 1.0 | 4.2 | 36.3 | 0.0 | 46.3 | 3.7 | ○ | ○ | Example |
| 58 | 1.2 | 3.9 | 32.1 | 0.0 | 43.6 | 3.8 | ○ | ○ | Example |
| 59 | 1.1 | 4.4 | 37.8 | 0.0 | 32.6 | 4.2 | Δ | Δ | Example |
| 60 | 1.3 | 0.5 | 22.3 | 0.0 | 63.0 | 3.2 | ◎ | ◎ | Example |
| 61 | 2.6 | 0.8 | 36.5 | 0.0 | 51.2 | 2.3 | ◎ | ◎ | Example |
| 62 | 0.5 | 1.2 | 17.2 | 0.1 | 43.5 | 1.4 | ◎ | ◎ | Example |
| 63 | 0.8 | 3.4 | 41.3 | 0.0 | 8.3 | 2.2 | ◎ | ◎ | Example |
| 64 | 1.2 | 1.1 | 11.9 | 0.0 | 31.5 | 0.9 | ◎ | ◎ | Example |
| 65 | 0.6 | 5.2 | 26.3 | 0.0 | 58.4 | 1.8 | ◎ | ◎ | Example |

*1 Total atomic ratio of K, Na, Mg, and Ca adsorbed on the surface to Cr

*2 Atomic ratio of Sn on the surface to Cr

The invention claimed is:

1. A surface-treated steel sheet having:

a Sn plating layer;

a metallic Cr layer disposed on the Sn plating layer; and a Cr oxide layer disposed on the metallic Cr layer, on at least one surface of a steel sheet, the surface-treated steel sheet having:

a water contact angle of 50° or less; and a total atomic ratio of K, Na, Mg, and Ca adsorbed on the surface to Cr of 5% or less.

2. The surface-treated steel sheet according to claim 1, wherein the Sn plating layer has a Sn coating weight of 0.1 g/m$^2$ to 20.0 g/m$^2$ per surface of the steel sheet.

3. The surface-treated steel sheet according to claim 1, wherein the metallic Cr layer has a thickness of 0.1 nm to 100 nm.

4. The surface-treated steel sheet according to claim 1, wherein the Cr oxide layer has a thickness of 0.5 nm to 15 nm.

5. The surface-treated steel sheet according to claim 1, having an atomic ratio of Sn on the surface of the surface-treated steel sheet to Cr of 100% or less.

6. The surface-treated steel sheet according to claim 1, further having a Ni-containing layer disposed below the Sn plating layer.

7. The surface-treated steel sheet according to claim 6, wherein the Ni-containing layer has a Ni coating weight of 2 mg/m$^2$ to 2000 mg/m$^2$ per surface of the steel sheet.

8. A method of producing a surface-treated steel sheet having: a Sn plating layer; a metallic Cr layer disposed on the Sn plating layer; and a Cr oxide layer disposed on the metallic Cr layer, on at least one surface of a steel sheet, the method comprising:

an electrolyte preparation process to prepare an electrolyte containing trivalent chromium ions;

a cathodic electrolysis treatment process to subject a steel sheet having a Sn plating layer on at least one surface to cathodic electrolysis treatment in the electrolyte;

a water washing process to subject the steel sheet after the cathodic electrolysis treatment to water washing at least once; and thereby producing the surface-treated steel sheet having:

a water contact angle of 50° or less; and a total atomic ratio of K, Na, Mg, and Ca adsorbed on the surface to Cr of 5% or less, wherein, in the electrolyte preparation process, the electrolyte is prepared by:

mixing a trivalent chromium ion source, a carboxylic acid compound, and water; and adjusting the pH to 4.0 to 7.0 and the temperature to 40° C. to 70° C., and in the water washing process, at least the last water washing uses water with an electrical conductivity of 100 μS/m or less.

9. The method of producing a surface-treated steel sheet according to claim 8, wherein the surface-treated steel sheet further has a Ni-containing layer disposed below the Sn plating layer.

* * * * *